US006941584B1

(12) United States Patent
Matthews

(10) Patent No.: US 6,941,584 B1
(45) Date of Patent: Sep. 13, 2005

(54) UNIVERSAL EARTH SUIT

(76) Inventor: George L. Matthews, FY 2288 Enterprises, P.O. Box 611525, Birmingham, AL (US) 35261

( * ) Notice: Subject to any disclaimer, the term of this patent is extended or adjusted under 35 U.S.C. 154(b) by 0 days.

(21) Appl. No.: 10/798,807

(22) Filed: Mar. 11, 2004

Related U.S. Application Data

(63) Continuation-in-part of application No. PCT/US03/22508, filed on Jul. 17, 2003.

(60) Provisional application No. 60/396,328, filed on Jul. 18, 2002.

(51) Int. Cl.[7] ..... A44D 13/02
(52) U.S. Cl. ..... 2/234; 2/69; 2/227
(58) Field of Search ..... 2/227, 228, 69, 2/69.5, 79, 456, 457, 50, 51, 94, 96, 234–237, 2/244, 247, 250, 408, DIG. 1, 2.17, 98, 78.2

(56) References Cited

U.S. PATENT DOCUMENTS

| | | | | | |
|---|---|---|---|---|---|
| 1,151,610 | A | * | 8/1915 | Powell | 2/79 |
| 1,405,421 | A | * | 2/1922 | Keck et al. | 2/79 |
| 1,418,124 | A | * | 5/1922 | Berkowitz | 2/79 |
| 1,465,415 | A | * | 8/1923 | Brunzel | 2/227 |
| 1,471,507 | A | * | 10/1923 | Smith | 2/79 |
| 1,749,167 | A | * | 3/1930 | Swanstrom | 2/79 |
| 1,896,183 | A | * | 2/1933 | Manson | 2/79 |
| 2,131,177 | A | * | 9/1938 | Horton et al. | 2/79 |
| 2,263,146 | A | * | 11/1941 | Smith | 2/79 |
| 2,521,767 | A | * | 9/1950 | Zecha | 2/79 |
| 2,849,717 | A | * | 9/1958 | Klotz | 2/79 |
| 3,086,215 | A | * | 4/1963 | Di Paola | 2/93 |
| 3,761,962 | A | * | 10/1973 | Myers | 2/79 |
| 3,909,849 | A | | 10/1975 | Botha | 2/79 |
| 3,949,427 | A | * | 4/1976 | Sampey | 2/79 |
| 3,956,774 | A | | 5/1976 | Spaulding | 2/79 |
| 3,994,026 | A | * | 11/1976 | Sampey | 2/79 |
| 4,447,911 | A | * | 5/1984 | Marcellaro | 2/79 |
| 4,457,025 | A | * | 7/1984 | Meryash | 2/79 |
| 4,513,451 | A | | 4/1985 | Brown | 2/69 |
| 4,535,480 | A | * | 8/1985 | Kunieda | 2/79 |
| 4,608,715 | A | * | 9/1986 | Miller et al. | 2/1 |
| 4,941,209 | A | * | 7/1990 | George | 2/79 |
| 5,093,932 | A | * | 3/1992 | Doyle | 2/114 |
| 5,331,685 | A | | 7/1994 | Belgard | 2/79 |
| 5,379,461 | A | | 1/1995 | Wilmers | 2/69 |
| 5,642,526 | A | * | 7/1997 | Thompson | 2/79 |
| 5,727,256 | A | | 3/1998 | Rudman | 2/115 |

(Continued)

OTHER PUBLICATIONS

Design Patent D279,042 Jun. 4, 1985 Aquilina et al.

*Primary Examiner*—Alissa L. Hoey
(74) *Attorney, Agent, or Firm*—Joseph H. Beumer

(57) ABSTRACT

A jump suit having features effective for both male and female users includes a central zippered opening extends downward from waistband along the crotch between left and right pants legs. A main zipper controlled by a pair of keepers and opens and closes the opening, which extends from the waistband in front to an upper end in the back located slightly above the waistband. This enables opening over the hips when a user is relieving himself. A large lapel on the front of the garment is movable by being folded from a first position where the lapel extends outward to one shoulder without crossing the center to a second position where the lapel extends toward the other shoulder and covers strip of a central vertical vent. Several vents and covering strips removably controlled by zippers are provided around the periphery of a main back panel.

11 Claims, 4 Drawing Sheets

U.S. PATENT DOCUMENTS 5,890,225 A * 4/1999 Marschall ..... 2/69
5,896,581 A * 4/1999 Wong ..... 2/78.2
5,983,401 A * 11/1999 Ohara ..... 2/227
6,070,274 A * 6/2000 van der Sleesen ..... 2/456
6,161,223 A 12/2000 Andrews ..... 2/234
6,243,878 B1 * 6/2001 Khemka et al. ..... 2/227
6,260,200 B1 7/2001 Alfred ..... 2/79
6,263,510 B1 7/2001 Bay et al. ..... 2/93
6,339,845 B1 1/2002 Burns et al. ..... 2/243.1
6,477,711 B1 11/2002 Freeman et al. ..... 2/69
6,745,400 B1 * 6/2004 Paciorkowski ..... 2/69
6,789,269 B1 * 9/2004 Scovin ..... 2/227

* cited by examiner

UNIVERSAL EARTH SUIT

CROSS REFERENCE TO RELATED APPLICATION

This application is a continuation-in-part of Application PCT U.S. 2003/022508, filed 17 Jul. 2003, which in turn claims the benefit of provisional application 60/396,328, filed Jul. 18, 2002.

BACKGROUND OF THE INVENTION

Field of the Invention

This invention relates to jump suits or coverall-type garments and more particularly to such garments designed with features effective for both male and female users.

Jump suits typically include an upper portion extending over the shoulders and a trouser-like lower portion integrally connected to the upper portion and covering the legs. A disadvantage of these garments is that removal or opening of the garment sufficiently to allow the wearer to relieve himself or herself may be burdensome or time-consuming, especially for females. Inclusion of features which facilitate handling of necessary body functions without requiring removal or opening of upper front or upper back portions would be desirable. This would allow these portions of the suit to be undisturbed and available for placement of other features such as cooling vents, a cape structure and a fold-over lapel usable as a display area.

SUMMARY OF THE INVENTION

The present invention is directed to a jump suit having a central zippered opening which runs from a first end at a waistband at the front of the garment, through the crotch and up to a second end at the small of the back. A main zipper controls this opening and enables the suit to be opened higher in the back than in the front to provide for opening over the hips when a person is relieving himself or herself. This zipper may have two keepers, which can be used to open and close the zipper, either part of the way or all of the way from front to rear or from rear to front. The main purpose of this two-way zipper is to allow for urination in the standing position by males and to provide a universal opening for members of both sexes.

Upper and lower parts of the suit, including front and back panels as well as trousers, are stitched to a waistband which holds the suit together and which includes an elastic strap across the back that serves to return these parts to their original positions after opening and closing of the central zippered opening, the waistband and elastic strap also giving shape and style to the suit. Upper parts of the suit include left and right front panels separated down the center and extending from a collar to the waistband. At the back of he suit a yoke extends across the shoulders, and a main back panel is connected to the yoke at the top of this panel and to the waistband at the bottom. Vents, which may be covered with a mesh material and overlapping flaps, are provided at selected locations around the periphery of the panels.

The upper front portion of the suit may include a lapel which is a cut-to-pattern part of the side panel and arranged for being folded over from a first position located away from the center between front panels to a second position wherein the lapel completely covers the center area. When in the first position the lapel provides a prominent space which may be used for displaying insignia, or for decorations and for other forms of self expression.

Pockets are provided at various locations for the convenience of the user, including a special pocket for holding a cell telephone.

It is therefore an object of this invention to provide a jump suit having an opening available to both male and female users for relieving themselves without removing or unfastening upper portions of the suit.

Another object is to provide a jump suit which includes vents at selected locations to enable cooling of the wearer.

Yet another object is to provide means for opening and closing vents disposed on jump suits.

Still another object is to to provide a jump suit having a display portion which may be deployed over an upper front location.

Other objects and advantages of the invention will be apparent from the following detailed description and the appended claims.

DESCRIPTION OF THE PREFERRED EMBODIMENT

Figure 1:
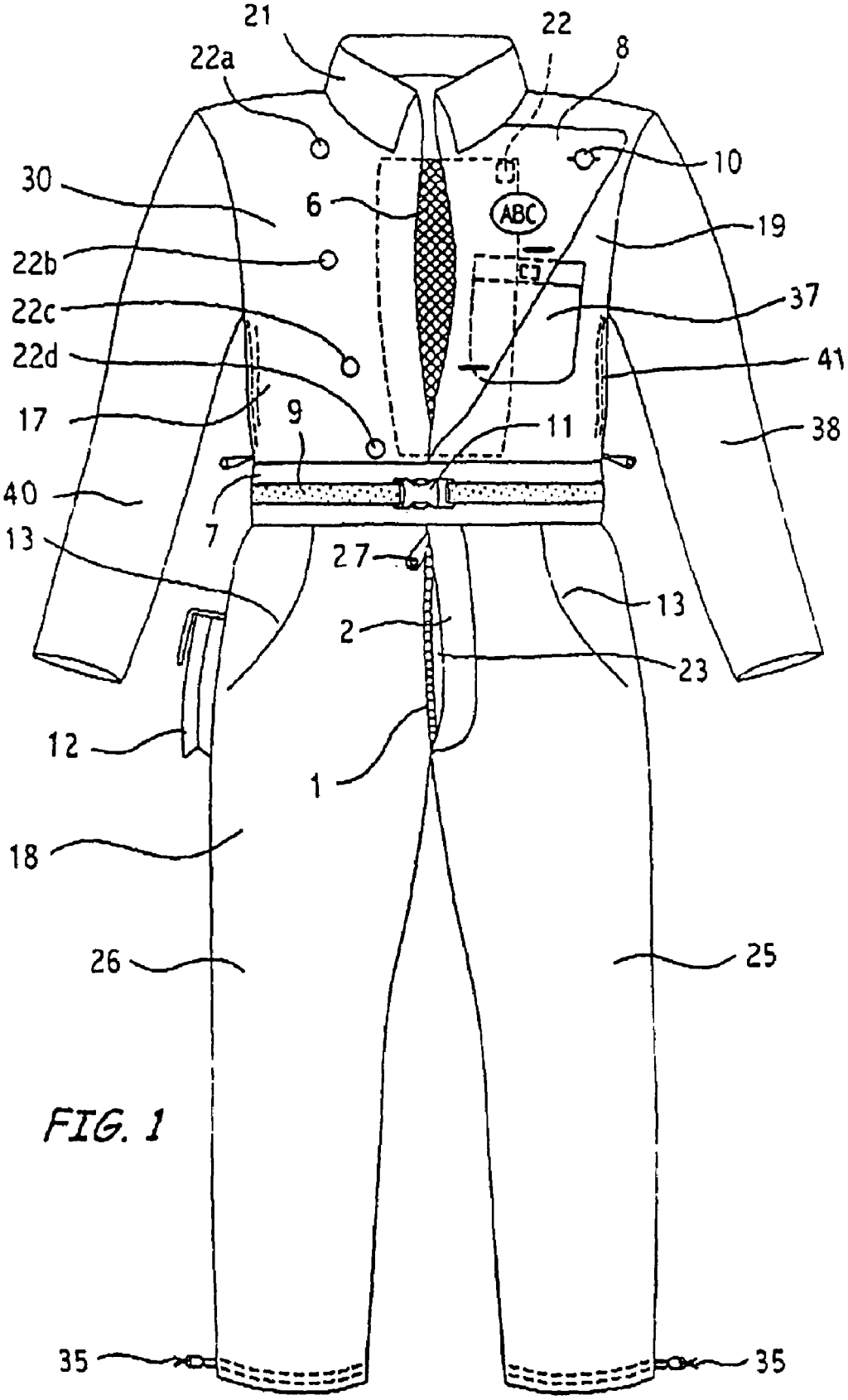
FIG. 1 is a front elevational view, partly broken away, showing a jumpsuit embodying the invention.

Referring to FIG. 1 of the drawings, there is shown a jump suit embodying the invention. The jump suit has an upper body portion 17 having connected thereto a left sleeve 38 and a right sleeve 40 and a lower pants portion 18, having a pair of drawstrings 35 connected to lower ends of each leg, each of these portions being stitched to a waistband 7. Front side parts of the upper body portion include a left panel 19 and a right panel 30, both of these panels connected to a collar 21 at the top and to the waistband at the bottom of the panel. A gap is defined between the two panels down the center of the suit. The gap is covered by a strip 6 of mesh material which enables ventilation while providing some protection from insects and debris. The strip is attached to one of the adjacent panels along one side of the strip, and the other side is open to allow the suit to be put on and taken off. In order to hold the strip in place when the strip is uncovered, a hook and loop "Velcro" connection 22 may be made between the strip and the underside of an adjacent panel, one of the patches of the connecting elements being connected to the strip and the other to the underside of the panel.

A generally triangular lapel 8 is a cut-to-pattern part of one of the panels, the lapel being movable back and forth between a first position wherein it is folded outwardly, leaving the strip uncovered so that ventilation through the mesh is enabled, to a second position where the lapel is folded inwardly, covering the vent and closing off ventilation. When in the first position the underside of the lapel is exposed, providing a substantial area including a prominent over the left side of the chest for possible uses as, a space for displaying insignia, logos and the like or, as a "Billboard for Self Expression", where messages could be displayed. Securing the folded lapel in the selected position may be provided by buttoning a top buttonhole to button 10 at the shoulder of the suit to which the tip of the lapel extends, which is the left shoulder as shown in FIG. 1. When folded over the mesh strip, the lapel may be secured by buttoning the edge of the lapel to buttons 22*a*, 22*b*, 22*c* and 22*d*, extending vertically down the suit at a location spaced apart further from the shoulder.

Figure 2:
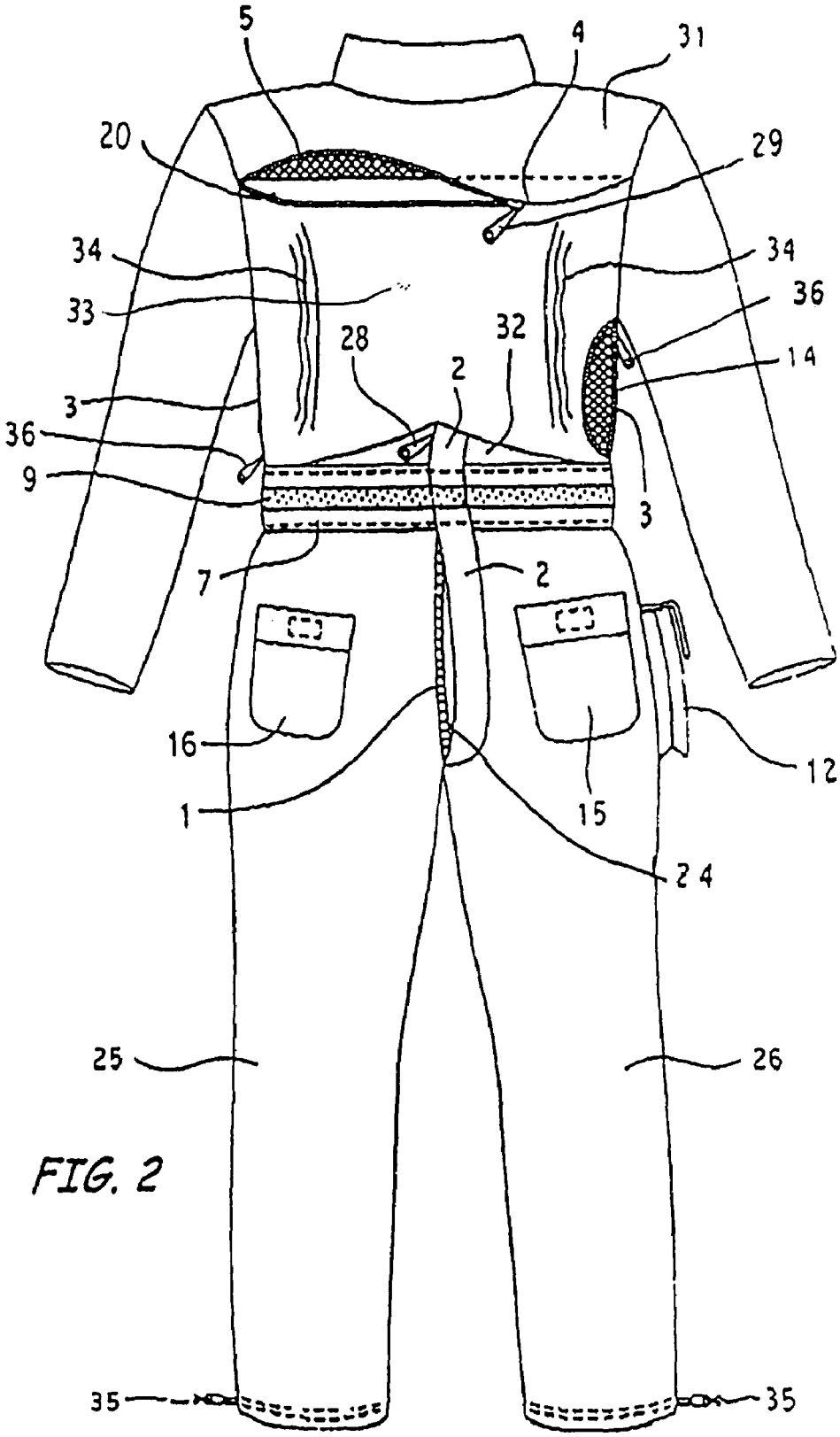
FIG. 2 is a back elevational view, partly broken away, showing features located on the backside of the jump suit.
Figure 3:
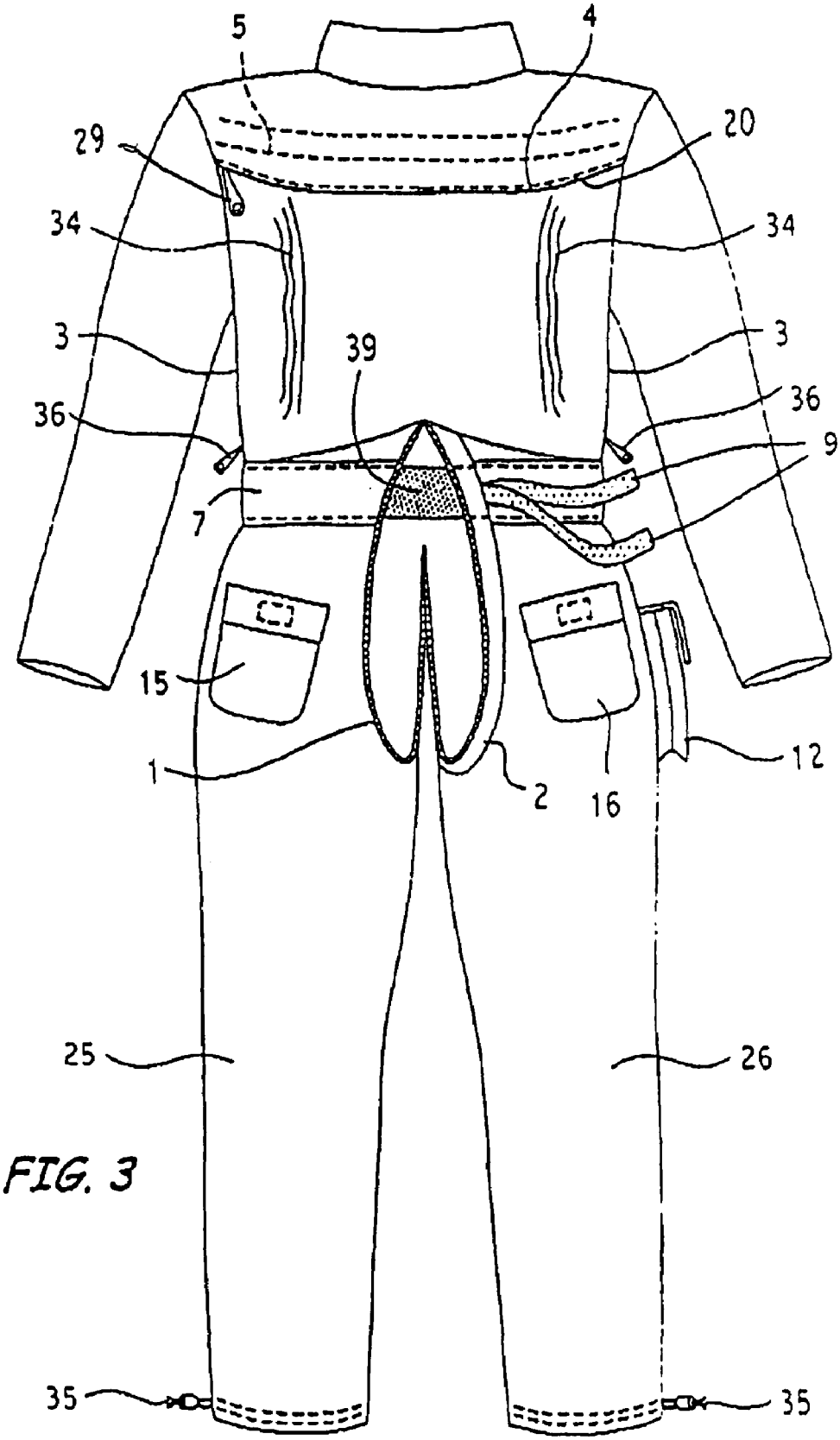
FIG. 3 is a back elevational view, partly broken away, showing further details of the crotch and waistband areas of the suit
Figure 4:
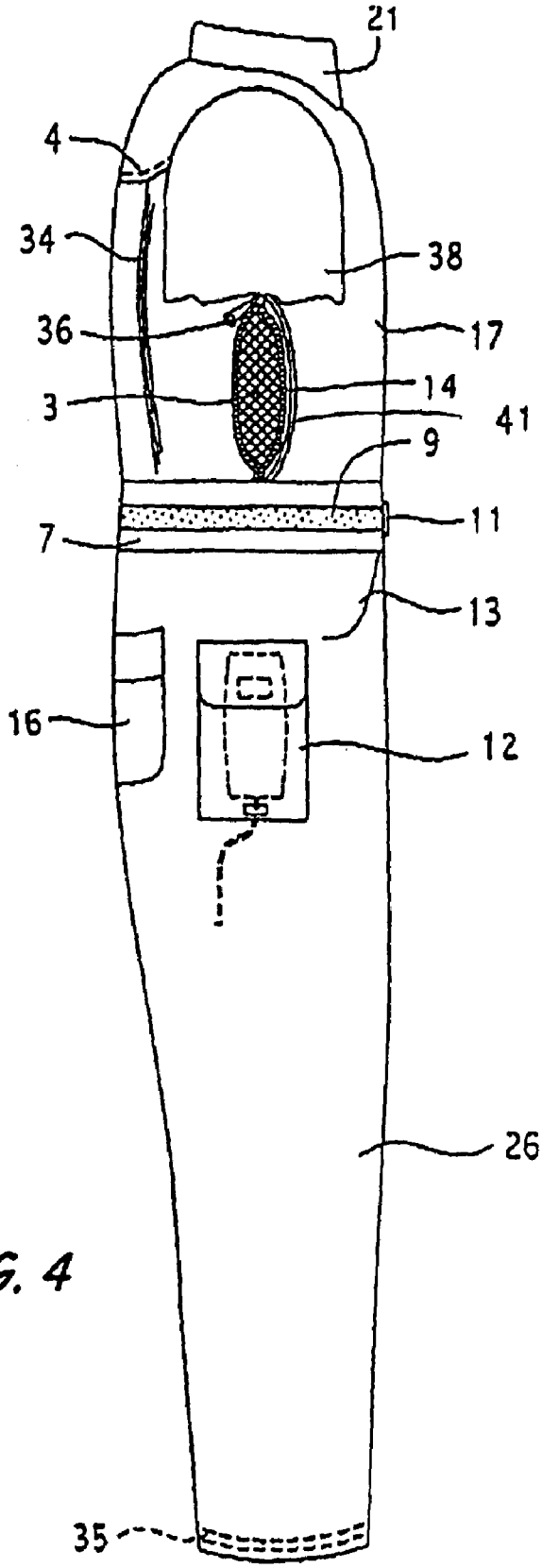
FIG. 4 is a side elevational view of the suit.

A central zippered opening 23 extends downward from waistband 7 along the crotch 24 between left pants leg 25 and right pants leg 26 and upward along the crotch at the backside as shown in FIG. 2 and FIG. 3. This main zipper 1 maybe controlled by a pair of keepers, a first keeper 27 at the front side and a second keeper 28 at the back side. The front side keeper can open the zipper from front to rear, and the backside zipper can open it from rear to front. This arrangement enables urination in the standing position by males. The zipper is covered by a displaceable flap 2 along its entire length.

FIG. 2. shows the overall structure of back side portions of the suit. A generally rectangular yoke 31 reaches across the shoulders, connected on its top edge to the collar and at its lower edge to a mesh strip 5 which provides a vent. This vent is covered by a lower flap 4 of the yoke connected to the main panel 33 by a zipper 20 operated by keeper 29. Closing the vent when required by weather conditions is thus enabled.

The main back panel 33 at its lower edge is stitched to waistband 7. An upward protruding triangular gusset 32 integral with waistband 7 is provided at a middle portion of the back side to support the upper end of the main zipper for being opened up to the small of the back. This enables opening over the hips when a person is relieving himself or herself. Increasing the length for a distance of 2 to 3 inches is suitable for this purpose.

The waistband 7 as shown in FIG. 3 has an elastic strap 39 disposed underneath the waistband and extending across the back, but not extending around the front. The elastic strap causes component panels of the garment to return to their original position upon opening or closing the central zippered opening. A belt 9 is connected to flap 2 which covers the main zipper and is secured by means of a belt buckle 11 which is located on the front side when buckled. Free ends of the belt 9 may be pulled away from the central opening as shown in FIG. 3 to enable opening of the main zipper over the hips when needed. The belt is sewn to the outer flap at the rear of the suit beneath end of the zipper and in line with the waistband. This ensures that the zipper will not be opened while the belt is fastened.

It is noted that the garment, in addition to having a vent at the middle of the front, has two zippered side vents provided by mesh strips 3 which extend on a line from the arm-pit to the top of the waist band. The vents may be opened and closed by zippers 14 operated by keepers 36. Spaced apart from these mesh strips and on the backside of the garment vertically extending pleats 34 provide ornamentation.

The side vents provide added air flow to cool the body. At each place where the suit has vented openings a "Sports Jersey" type mesh material may be placed across the opening. This allows added air-flow, while providing a measure of protection against insects and debris. When all of the zippers are in the closed position, the garment is more secure and warm.

Pleats 41 (FIG. 1) are placed over the mesh strips 3 to provide improved ventilation. These pleats are open to the rear, the backward pleats directing the flow of air.

A cell phone pocket 12 may be located on the right side of the garment between the front and rear pockets, providing convenient placement for these devices. This pocket preferably has an unfolding structure which may be expanded to fit various sizes of cell phones. A Velcro closure and a a small opening at the bottom of the pocket may also be included, the opening allowing easier connection of the cell phone to other devices.

The suit on its upper front portion may also have a pocket 37 for carrying glasses, a notebook or other utility items. The pants portion of the garment may have front pockets 13 and back pockets 15 and 16, with a button for securing items such as a wallet.

While the invention is described above in terms of a specific embodiment, it is not to be understood as limited to the details of this embodiment, but is limited only as indicated by the appended claims.

What is claimed is:

1. A jump suit comprising an upper body portion, a lower pants portion and a waistband assembly connected to a lower edge of said upper portion and to an upper edge of said pants portion;

said upper body portion having a front side including a left panel and a right panel, said panels defining a vertical gap therebetween extending from said waistband to a collar at a top location, said gap providing a vent;

said upper body portion having a back side including a yoke extending across the suit from a left shoulder to a right shoulder, a main back panel connected to said yoke at along a top edge of said back panel and connected to said waistband along a bottom edge thereof;

side edge portions of said main back panel and said front side panels having defined therebetween a pair of zippered vertically extending vents;

said lower pants portion including a left leg portion and a right leg portion defining a crotch opening therebetween;

said waistband assembly including an upward projecting support member at a middle location on a backside thereof, said projecting member connected to said waistband, extending upward to a position above the waist and up to the small of the back of a user and having defined therein an upper end extension of said crotch opening; and a main zipper disposed for opening and closing the extended crotch opening.

2. A jumpsuit as defined in claim 1 including a lapel connected to one of said front side panels, the lapel being arranged for folding over from one position located away from said gap between said panels and thus exposing the gap to another position in which the lapel covers the gap and exposes the back side of the lapel.

3. A jump suit as defined in claim 2 wherein said lapel is triangular.

4. A jump suit as defined in claim 1 further comprising a strip of mesh material disposed in a position covering said gap.

5. A jump suit as defined in claim 1 wherein said waistband assembly further comprises an elastic strap disposed underneath said waistband and extending across a backside of the waistband.

6. A jump suit as defined in claim 5 wherein said waistband assembly further comprises a belt disposed over said waistband and secured to a flap which covers the main zipper.

7. A jump suit as defined in claim 1 wherein said main zipper includes a pair of keepers.

8. A jump suit as defined in claim 7 wherein one of said keepers is disposed in a position accessible to a user from the back.

9. A jump suit as defined in claim 1 including perforated mesh strips located across each of said vertically extending vents.

10. A jump suit as defined in claim 1 wherein said upward projecting support member comprises a gusset.

11. A jump suit as defined in claim 10 wherein said gusset extends upward for a length of two to three inches at the middle location of said backside.

* * * * *